United States Patent [19]

Negishi

[11] Patent Number: 4,734,836

[45] Date of Patent: Mar. 29, 1988

[54] LIGHTING APPARATUS

[76] Inventor: Masataka Negishi, 29-19, Daito 2-Chome, Urawa-shi, Saitama-ken, Japan

[21] Appl. No.: 878,967

[22] PCT Filed: Sep. 30, 1985

[86] PCT No.: PCT/JP85/00540

§ 371 Date: May 22, 1986

§ 102(e) Date: May 22, 1986

[87] PCT Pub. No.: WO86/02139

PCT Pub. Date: Apr. 10, 1986

[30] Foreign Application Priority Data

Sep. 29, 1984 [JP] Japan ..... 59-147856[U]

[51] Int. Cl.[4] ..... F21V 5/00

[52] U.S. Cl. ..... 362/311; 362/223; 362/340; 313/110; 350/432

[58] Field of Search ..... 313/110; 350/432–435; 362/223, 311, 340

[56] References Cited

U.S. PATENT DOCUMENTS

| | | | |
|---|---|---|---|
| 639,687 | 12/1899 | Pennycuick et al. | 362/340 |
| 1,858,497 | 5/1932 | Hall | 313/110 X |
| 1,870,247 | 8/1932 | Froget | 362/340 X |
| 1,880,892 | 10/1932 | Dodge | 313/110 X |
| 2,595,771 | 5/1952 | Curzon | 362/223 |

FOREIGN PATENT DOCUMENTS

| | | | |
|---|---|---|---|
| 503745 | 7/1930 | Fed. Rep. of Germany | 313/110 |
| 1122629 | 1/1962 | Fed. Rep. of Germany | 313/110 |
| 777012 | 2/1935 | France | 313/110 |
| 50-103567 | 8/1975 | Japan . | |
| 50-116280 | 9/1975 | Japan . | |
| 52-133582 | 10/1977 | Japan . | |
| 56-141304 | 10/1981 | Japan . | |
| 58-61645 | 4/1983 | Japan . | |

OTHER PUBLICATIONS

"Lamp Bulb Package", *IBM Tech. Discl. Bulletin*, vol. 6, No. 5, Oct. 1983, pp. 59–60.

*Primary Examiner*—Samuel Scott
*Assistant Examiner*—Allen J. Flanigan
*Attorney, Agent, or Firm*—Ladas & Parry

[57] ABSTRACT

A three dimensional light control lens (2, 2A, 2B) of special configuration is fitted on the outer surface of a cylindrical or spherical light source (1, 1A, 1B) so as to cover at least a part thereof directly. A light coming out of the light source is transmitted through the light control lens and emitted. The light control lens (2, 2A, 2B) is of such three-dimensional shape as to control the luminous flux from the light source (1, 1A, 1B) to have a predetermined distribution and range of incidence. Typically, the sectional shape of the light control lens taken along a plane including the luminous flux which has passed therethrough is such as to have a pair of swelled portions (2*a*) protruding in the direction away from the light source, and a recessed portion (2*c*) recessed on the side counter to the light source between the swelled portions, the swelled portions (2*a* and 2*a*) and the recessed portion (2*c*) having a shape bounded and defined by a smoothly continuous curve. The light control lens also has various other possible sectional shapes.

11 Claims, 15 Drawing Figures

LIGHTING APPARATUS

TECHNICAL FIELD

The present invention relates to a lighting apparatus provided with a light control lens capable of freely controlling as desired the luminous flux being emitted from a light source.

BACKGROUND ART

Normally, a lens is inserted in a path of the light from a light source, thereby controlling the luminous flux being emitted from the light source. However, a conventional lens must be installed some distance away from the light source, and a structure for supporting the lens must also be provided. Further, a conventional lens cannot be used where the light source is of elongated shape, and the luminous flux cannot be controlled to provide a desired flux distribution and a range of incidence.

An object of the present invention is, therefore, to provide an improved arrangement wherein a support structure is not particularly required for a lens, because the lens is supported directly on the light source, whereby a lighting apparatus can be configured compactly, and further, the luminous flux can be controlled freely as desired by the lens.

DISCLOSURE OF THE INVENTION

The lighting apparatus, according to the invention, comprises a light source and a light control lens supported on the outer surface of the light source, to cover at least a part thereof directly, the light control lens being a three dimensional solid configured to control the luminous flux coming out of the light source and passing therethrough so as to have a predetermined flux distribution and range of incidence.

BEST MODES FOR CARRYING OUT THE INVENTION

Figure 1:
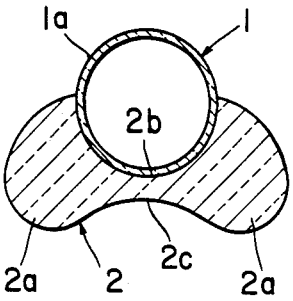
FIG. 1 is a sectional view of one embodiment of the invention.

FIG. 1 represents the basic structure of an embodiment of the lighting apparatus of the invention. In this figure, reference numeral 1 denotes a light source, which is, for example, a fluorescent light emitting tube, a cold cathode discharge tube, or the like, and has a cylindrical outer surface 1*a*. A light control lens 2 is provided so as to directly cover a semi-cylindrical portion of the outer surface 1*a*. In cross section taken along a plane including a luminous flux passing through the light control lens 2, the lens 2 has a shape consisting of swelled portions 2*a* and 2*a* on two opposed sides, a recessed portion 2*c* close to the light source 1 located intermediately between the two swelled portions 2*a* and 2*a*, and another recessed portion 2*b* at the reverse side which is fitted on and in contact with the light source 1. The light control lens 2 is formed to cover the overall length of the light source 1 with the illustrated sectional shape and forms an integral structure with the light source 1 by the fitting thereon, for example. The recessed portion 2*b* has the same configuration as the light source 1, and the swelled portions 2*a* and the recessed portion 2*c* have a shape bounded and defined by a smoothly continuing curve.

Figure 2:
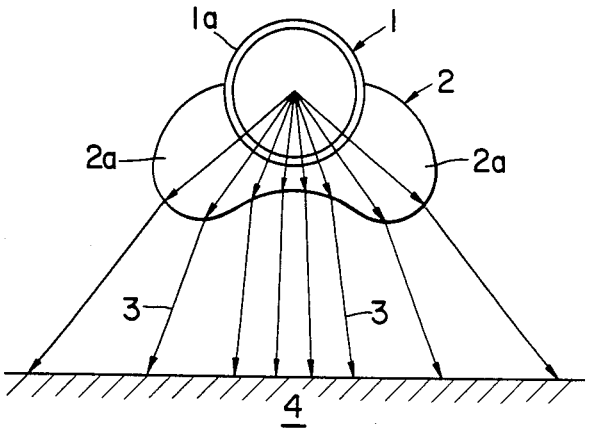
FIG. 2 is a view explanatory of the function of the embodiment shown in FIG. 1.

In the lighting apparatus using the light control lens 2 of the shape shown in FIG. 1, light emitted from the light source 1 is irradiated on a surface 4 to be illuminated with such a luminous flux distribution as indicated by arrows 3 through the light control lens 2, as shown in FIG. 2. That is, the light flux is widened or diverged through the light control lens 2 before reaching the surface 4 which is to be illuminated. In this case, the luminous flux reaching the surface 4 to be illuminated can be made uniform in distribution throughout the whole surface or can be controlled so as to have some specific portion or portions higher or lower in luminous flux density. This can be varied as desired by varying the sectional shape of the light control lens 2. Design of the sectional shape of the light control lens can be carried out by using a computer if dimensions of the light source, light incidence range of the luminous flux, and luminous flux distribution are determined.

Figure 3:
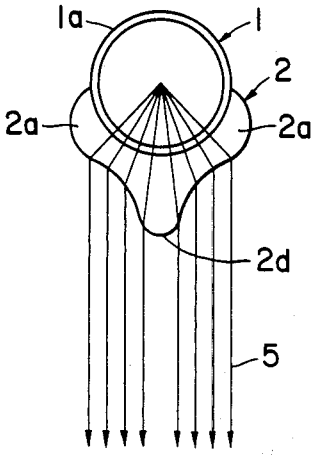
FIG. 3 is a view showing another embodiment of the invention.

FIG. 3 shows an embodiment wherein the light emitted from the light source 1 is converted into a parallel luminous flux 5 through the light control lens 2. In this case the light control lens 2 is shaped in cross section to have a projected portion 2*d* at the center, the swelled portions 2*a* and 2*a* on both sides being smaller than those shown in FIG. 2 and relatively this so that their outer surface is closer to the outer surface of the light source 1.

Figure 4:
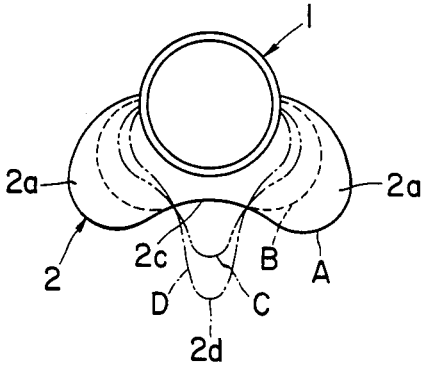
FIG. 4 is an explanatory view showing variations of the shape of the light control lens used in the present invention.

FIG. 4 shows changes in the cross-sectional shape of the light control lens 2 depending on the luminous flux required. In the case of the cross-sectional shape indicated by reference character A, where the luminous flux is to be widened or diverged fully, the swelled portions 2*a* and 2*a* on both sides are the largest and the recessed portion 2*c* is present on the front surface, while in the case of the shape indicated by reference character B, where the luminous flux is to be less divergent, both of the swelled portions 2*a* and 2*a* are lower and the recessed portion 2*c* is shallower. When the luminous flux is to be made parallel, both the swelled portions 2*a* are further lowered, the recessed portion 2*c* disappears and the projected portion 2*d* protrudes on the front surface, as indicated by cross-sectional shape C, and when the luminous flux is to converge, the swelled portions 2*a* on both sides are made lower further, as indicated by cross-sectional shape D, and the projected portion on the front is made much higher.

Figure 5A:
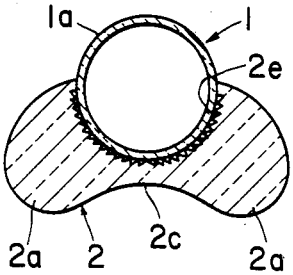
FIG. 5A is a sectional view of another embodiment of the invention.
Figure 5B:
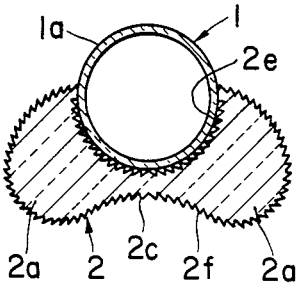
FIG. 5B is a sectional view showing a modification of the embodiment of FIG. 5A.

The light control lens 2 may be made of glass. However, it can also be made of a transparent synthetic resin such as acrylic resin, polycarbonate resin or the like. Further, to allow heat from the light source 1 to dissipate, a slight clearance or grooves may be formed between the outer surface 1a of the light source and the recessed portion 2*b* of the light control lens 2. Still further, as shown in FIG. 5A, a Fresnel surface 2*e* can be formed having a multiplicity of parallel ribs, triangular in cross section, formed on the recessed portion of the light control lens 2 adjacent to the light source. In this case, further light control is made by the Fresnel surface 2*e*. A similar Fresnel surface 2*f* may be provided on the outside of the light control lens 2, as shown in FIG. 5B. The Fresnel surfaces 2*e* and 2*f* may both be provided, or one of them may be dispensed with. The formation of the Fresnel surface or surfaces will make possible reduction of thickness of the thick portions 2*a* of the light control lens 2 as in the case of the known Fresnel lenses, thereby obtaining a control lens which is entirely substantially uniform in thickness.

Figure 6:
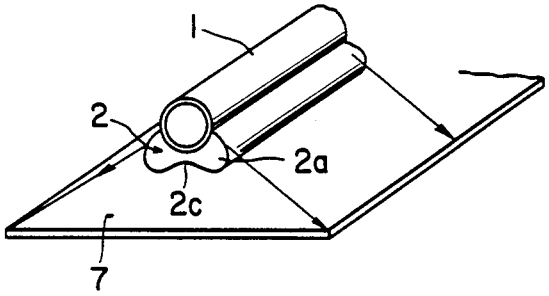
FIGS. 6 and 7 are perspective views showing different modes of application of the embodiment shown in FIG. 1.

FIG. 6 represents an example of application of the embodiment shown in FIG. 2. In this example, the light control lens 2 controls light from the light source 1 and sends a luminous flux to the surface of a light transmissive, light diffusion plate 7 with a uniform light flux distribution, whereby the diffusion plate 7 is made luminous with an entirely uniform illuminance on the back surface thereof. In this case, the light control lens 2 can be so designed as to control the incidence range of light in a manner to prevent the light from arriving outside of the surface of the diffusion plate 7, thus producing little or no light loss.

In contrast, in conventional surface lighting apparatus, only a passive method, such as disposing the light source farther away from the light diffusing surface, or increasing the thickness of the diffusion plate is commonly used for preventing the light diffusion plate from having light and dark areas depending upon the position of the light source, but still, such method entails a loss of light, and the thickness of the lighting apparatus inevitably increases. However, such problems can be solved by the example.

Figure 7:
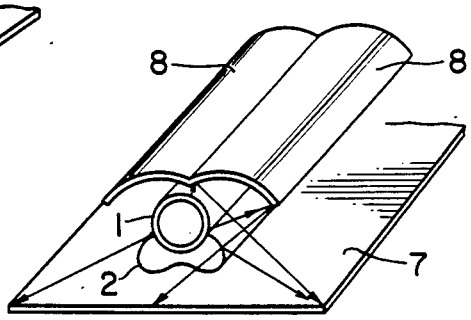

In the example of application shown in FIG. 7, the arrangement is such that light coming out of the back side (the side where the light control lens 2 is not provided) or the light source 1 is reflected by mirrors 8 and 8 provided on the back, is directed to the surface of the diffusion plate 7 as a luminous flux distributed uniformly, and is then superposed on the luminous flux which has passed through the light control lens 2 as in the example of FIG. 6. In this example, loss of light can be further decreased by so shaping the mirrors 8 and 8, through computer design, that they produce a reflected luminous flux which is distributed uniformly.

FIGS. 6 and 7 represent the examples where a luminous flux of uniform distribution is produced. However, the luminous flux could be made to have a non-uniform pattern as desired, as mentioned hereinabove.

Figure 8:
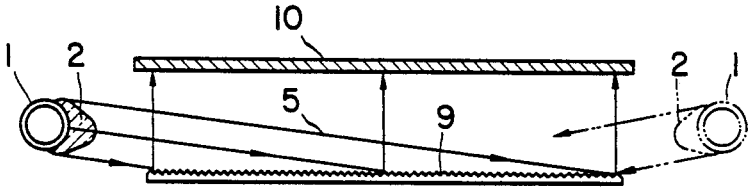
FIGS. 8 and 9 are views showing different modes of application of the embodiment shown in FIG. 3.

FIG. 8 represents an example where the lighting apparatus for generating parallel luminous flux, as shown in FIG. 3, is used for surface illumination having a uniform light flux distribution. Light from the light source 1 is converted into a parallel luminous flux 5 through the light control lens 2, reflected by a Fresnel reflection mirror 9 and is then directed to a light transmissive, light diffusion plate 10 as a uniformly distributed luminous flux increased in width. As a result, the upper surface of the diffusion plate 10 is made luminous with a uniform illumination distribution. According to this example, an extremely thin surface lighting apparatus can be obtained. Similar light source 1 and light control lens 2 could also be provided on the right side of FIG. 8, as indicated by chain lines, so as to send parallel luminous flux to the Fresnel reflection mirror 9.

Figure 9:
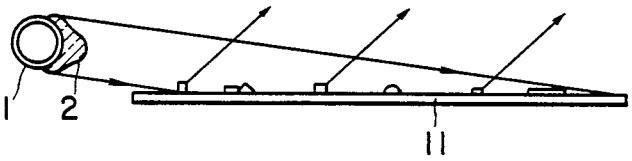

In the example of FIG. 9, a parallel luminous flux of uniform distribution which has passed through the light control lens 2 is irradiated slantwise onto the surface of a printed substrate 11 having electronic parts thereon. LCDs could be provided on the outside surface of the diffusion plate 10, thereby enabling observation of an image on the outside from the top. When an inspection is to be made by applying a light on the printed substrate 11 as described, the reflected light as viewed in a direction is required to be uniform in brightness, and this may easily be realized from applying the example of FIG. 3.

Figure 10:
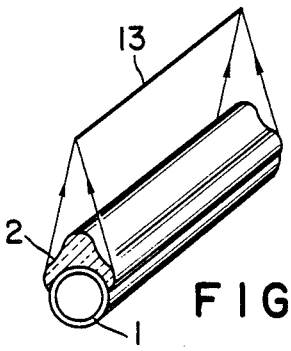
FIG. 10 is a perspective view showing an embodiment of the invention for producing a bright line.

In the embodiment of the invention shown in FIG. 10, the shape of the light control lens 2 is designed so that light which has passed therethrough will be converged to form a bright line 13. Such bright line 13 can be used for scanning in copying machines, facsimile machines and the like.

Figure 11:
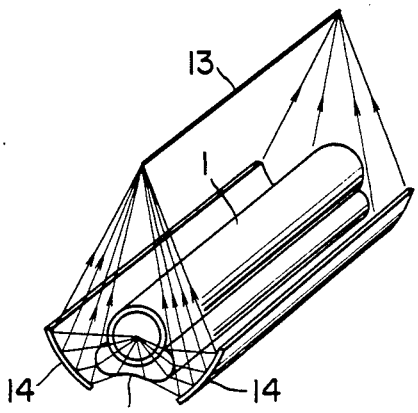
FIG. 11 is a perspective view showing an example wherein a bright line is produced by means of the embodiment of FIG. 1.

FIG. 11 represents an example wherein the light control lens 2 is similar to that in the example of FIG. 2, and wherein the luminous flux which has been widened by the light control lens 2 is directed onto and reflected by mirrors 14 and 14 to produce a bright line 13.

Figure 12:
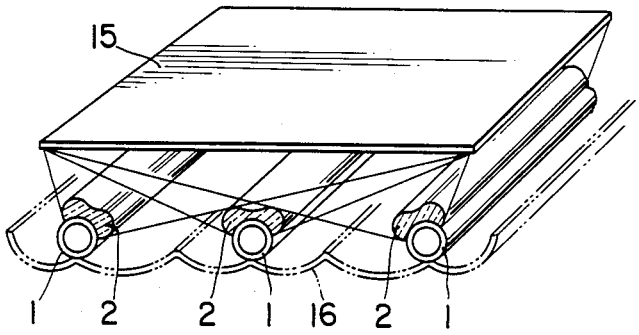
FIG. 12 is a perspective view showing another application of the embodiment of the invention.

In the example of application shown in FIG. 12, three lighting apparatus as that shown in FIG. 2, wherein the luminous flux is widened to produce a uniform distribution, are provided for the three primary colors, respectively, and luminous fluxes of the three primary colors distributed uniformly are irradiated on a light transmissive, light diffusion plate 15. In a conventional light box of this kind when three illumination light sources for the three primary colors are provided, the three primary colors, red, green and blue, are displayed unevenly or non-uniformly on the diffusion plate. However, in this example, the three primary colors, or two colors, arbitrarily chosen, are mixed uniformly, covering the overall surface of the diffusion plate 15, and if the light source for any one of the three colors is lighted, the overall surface of the diffusion plate 15 is made luminous uniformly with the one color. In this example, a mirror 16 similar to the mirror 8 shown in FIG. 7 may be provided.

Figure 13:
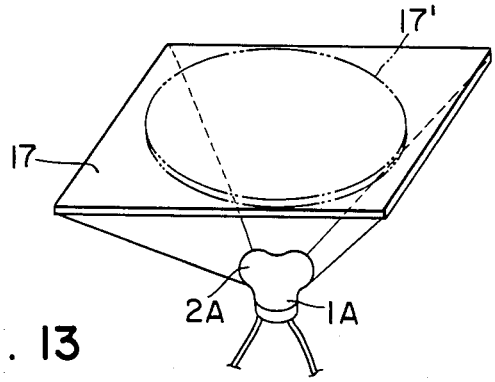
FIG. 13 is a perspective view of a further embodiment of the invention.

The light source need not necessarily be an elongated one, having the above mentioned length, but may be a point source, such as a spherical one. One example is as shown in FIG. 13, where a point source (spherical light source) 1A is covered with a light control lens 2A on the outer surface thereof. The light control lens 2A is so shaped three dimensionally that it will direct the luminous flux for uniform distribution on the overall surface of a square light transmissive, light diffusion plate 17. It is also possible to direct the luminous flux only in a disk-like area with a uniform distribution if the diffusion plate 17 has the shape of a disk, as indicated by the dotted line 17'.

Figure 14:
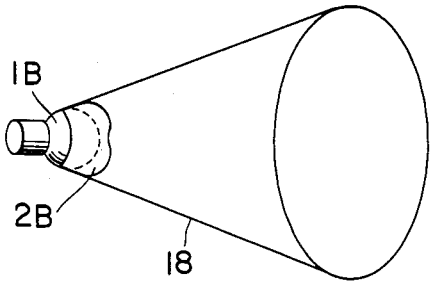
FIG. 14 is a perspective view of a still further embodiment of the invention.

In the embodiment shown in FIG. 14, a light control lens 2B is placed detachably on an almost spherical light source 1B (incandescent lamp, for example), thereby obtaining a uniformly-distributed luminous flux 18.

In the embodiments described above, the outer surface of the light source is in the shape of a bulb, and the light control lens is put on the outside of the bulb. However, the outer surface wall of the light source may, intself, be shaped as a light control lens.

According to the present invention, a lens for controlling the light emitted from the light source is provided directly on the outer surface of the light source, and therefore, a separate supporting device is not particularly required for the lens. Further, the lens is formed as a member fixed to the light source, so that space can be saved reasonably and the entire lighting apparatus can be simplified to a compact structure.

INDUSTRIAL APPLICABILITY in the present invention, a light control lens is so shaped, three dimensionally, as to control the luminous flux freely as desired, whereby the invention is applicable extensively to lighting apparatus, display units and other equipment.

What is claimed is:

1. A lighting apparatus, comprising: a light source having an outer surface circular in cross section; and a light control lens having a recess complemental to said outer surface and fitted directly on said outer surface by means of said recess in a manner to cover at least a part of said outer surface and to cause luminous flux from the light source to pass through the lens so as to be emitted outward, said light control lens, in its section taken along a plane passing through an optical axis of said luminous flux, having a pair of spaced apart swelled portions disposed on opposite sides of said optical axis and protruding in directions away from the light source and in the directions of said luminous flux, and a recessed portion formed on the opposite side of said recess and between the swelled portions, said swelled portions and recessed portion having convex and concave contours, respectively, so bounded and defined by a smoothly continuous curve as to produce a diverging luminous flux and a predetermined distribution and range of incidence of the luminous flux.

2. The lighting apparatus as defined in claim 1, wherein the predetermined distribution is a uniform distribution.

3. The lighting apparatus as defined in claim 1, wherein the surface of said recess of the lens is a Fresnel surface.

4. The lighting apparatus as defined in claim 1, wherein the surfaces of said swelled portions and said recessed portion are formed of Fresnel surfaces.

5. The lighting apparatus as defined in claim 1, wherein said light source has a cylindrical outer surface and said light control lens has such a size as to cover substantially a semicylindrical surface part of the light source.

6. The lighting apparatus as defined in claim 1, wherein said light source has a substantially spherical shape and said light control lens has such a size as to cover substantially a hemispherical surface part of the light source.

7. The lighting apparatus as defined in claim 1, wherein a minute clearance is formed between the recess of the light control lens and the outer surface of the light source.

8. A lighting apparatus, comprising: a light source having an outer surface circular in cross section; and a light control lens having a recess complemental to said outer surface and fitted directly on said outer surface by means of said recess in a manner to cover at least a part of said outer surface and to cause luminous flux from the light source to pass through the lens so as to be emitted outward, said light control lens, in its section taken along a plane passing through an optical axis of said luminous flux, having a pair of swelled portions disposed on opposite sides of said optical axis and having a thickness in directions away from the light source and in the directions of said luminous flux, and a convex projected portion formed on the opposite side of said recess and between the swelled portions, said swelled portions and recessed portion having contours so bounded and defined by a smoothly continuous curve as to produce a predetermined distribution and range of incidence of the luminous flux.

9. The lighting apparatus as defined in claim 8, wherein the predetermined distribution is a uniform distribution.

10. The lighting apparatus as defined in claim 8, wherein said light source has a cylindrical outer surface and said light control lens has such a size as to cover substantially a semicylindrical surface part of the light source.

11. The lighting apparatus as defined in claim 8, wherein said light source has a substantially spherical shape and said light control lens has such a size as to cover substantially a hemispherical surface part of the light source.

* * * * *